United States Patent [19]

Rizzardi

[11] Patent Number: 5,016,770

[45] Date of Patent: May 21, 1991

[54] SEALING CAP ESPECIALLY FOR ANTIBIOTIC, INFUSION AND TRANSFUSION BOTTLES

[76] Inventor: Napoleone Rizzardi, Via Zambeletti, 10, 20129 Milan, Italy

[21] Appl. No.: 340,559

[22] Filed: Apr. 18, 1989

[30] Foreign Application Priority Data

Apr. 18, 1988 [IT] Italy ..... 21082[U]

[51] Int. Cl.[5] ..... B65D 41/00

[52] U.S. Cl. ..... 215/232; 215/249; 215/251; 215/305

[58] Field of Search ..... 215/232, 247, 251, 305, 215/249

[56] References Cited

U.S. PATENT DOCUMENTS

| | | | |
|---|---|---|---|
| 1,413,703 | 4/1922 | Biehn | 215/247 |
| 3,439,825 | 4/1969 | Glensky | 215/251 |
| 3,712,498 | 1/1973 | Lawrence | 215/247 |
| 3,904,059 | 9/1975 | Bellamy, Jr. et al. | 215/247 |
| 4,243,150 | 1/1981 | Gunne et al. | 215/247 |
| 4,244,478 | 1/1981 | Handman | 215/251 X |
| 4,301,936 | 11/1981 | Percarpio | 215/247 |
| 4,364,485 | 12/1982 | Knapp | 215/247 X |
| 4,456,138 | 6/1984 | Bereziat | 215/251 X |
| 4,553,679 | 11/1985 | Hatakeyama et al. | 215/232 |
| 4,767,016 | 8/1988 | Cook, Jr. et al. | 215/232 X |

FOREIGN PATENT DOCUMENTS

| | | | |
|---|---|---|---|
| 3130246 | 2/1983 | Fed. Rep. of Germany | 215/251 |

*Primary Examiner*—Stephen Marcus
*Assistant Examiner*—Nova Stucker
*Attorney, Agent, or Firm*—Michael J. Striker

[57] ABSTRACT

A sealing cap of metallic material, particularly for antibiotic, infusion and transfusion bottles, provided with a hole (7) on its upper wall (5), tightly closed by a metallic foil (8) substantially covering the whole wall (5) and provided with a knurled grip tongue (10) that does not project beyond the outline of the cap (2).

5 Claims, 1 Drawing Sheet

SEALING CAP ESPECIALLY FOR ANTIBIOTIC, INFUSION AND TRANSFUSION BOTTLES

BACKGROUND OF THE INVENTION

The invention relates to an aluminium sealing cap, especially for antibiotic, infusion and transfusion bottles. Sealing caps of said kind are already known and proposed in various forms.

Said caps are provided on their upper wall with a blanked disk or a hole closed by an auxiliary element, removable during bottle utilization in order to allow access to an underlying rubber seal which is pricked by a syringe needle.

Said known caps give no sufficient security against dust or bacteria infiltrations which may reach the rubber seal outer surface, endangering the sterilization of the syringe needle which has to perforate the rubber seal.

The removal of the blanked disk or the auxiliary element appears moreover a rather laborious operation, and is often necessary to accomplish it with the aid of a tool.

The Italian model application no. 22314 B/82 of July 2, 1982, in the name of the same applicant, CAPSULIT S.p.A., shows a sealing cap for bottles of the above mentioned kind provided with a central hole covered with a metallic foil which preferably occupies a portion of the cap upper wall and shows a projecting grip tongue in order to facilitate its removal.

A cap so shaped offers a good sealing against dust and bacteria infiltrations and appears to be easily useable.

Anyway some inconveniences were found during the bottle filling and closing in the cap fitting machines, such as jammings of the said machines, due to the presence of the tongue projecting from the metallic foil covering the caps.

SUMMARY OF THE INVENTION

The object of the invention is to eliminate said inconveniences and provide a sealing cap offering a almost total security against dust and bacteria infiltrations and simple to be utilized.

The sealing cap according to said invention has on its upper wall a through hole which is tightly closed by a thin metallic foil covering substantially the whole cap upper wall and having a knurled tongue, not projecting from the cap lateral edge and apt to facilite the removal.

Preferably both the cap upper wall and the metallic foil inner surface are covered with acquer and the foil is fasten around the cap by welding at least along a closed line enclosing the hole provided in the cap.

The welding may be conveniently executed on the whole surface of the metallic foil, except for the portion intersected by the knurled tongue, so that the metallic foil completely adheres to the cap upper wall, including the knurled tongue, which, anyway, may be easily taken to remove the foil.

The sealing cap of said invention will now be described according to a preferred embodiment with reference to the enclosed drawings, wherein:

DETAILED DESCRIPTION OF THE PREFERRED EMBODIMENT

Figure 1:
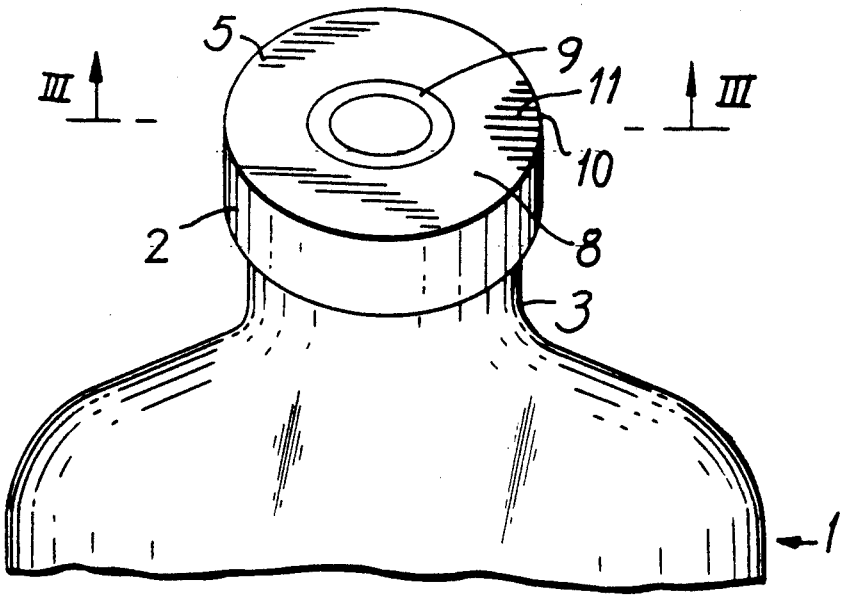
FIG. 1 is a perspective view of the sealing cap according to the invention, applied on a bottle.
Figure 2:
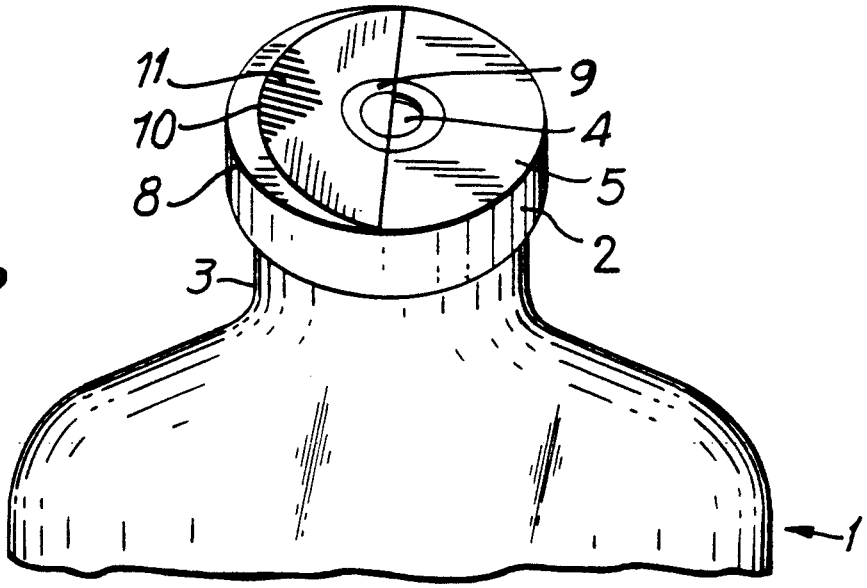
FIG. 2 is a perspective view of, the cap of FIG. 1 during the removal of the metallic foil applied on the upper wall.

In the drawing, reference 1 indicates a container, in this particular instance a bottle particularly containing a powdered medicine.

Onto the bottle neck 3 is applied a cap 2 by rolling its lower edge 2' around an annular collar 3' of the neck. Between the cap 2 and the bottle opening is interposed a rubber sealing element 4 pressed against the opening by the cap upper wall 5 (see FIG. 3).

The sealing element 4 has a tubular appendix 6 entering the bottle opening with a scant clearance and provided with annular collar 6' apt to increase the grip. Obviously, the sealing element 4 may be made of a simple disk seal resting on the bottle opening, or in any other known manner.

Figure 3:
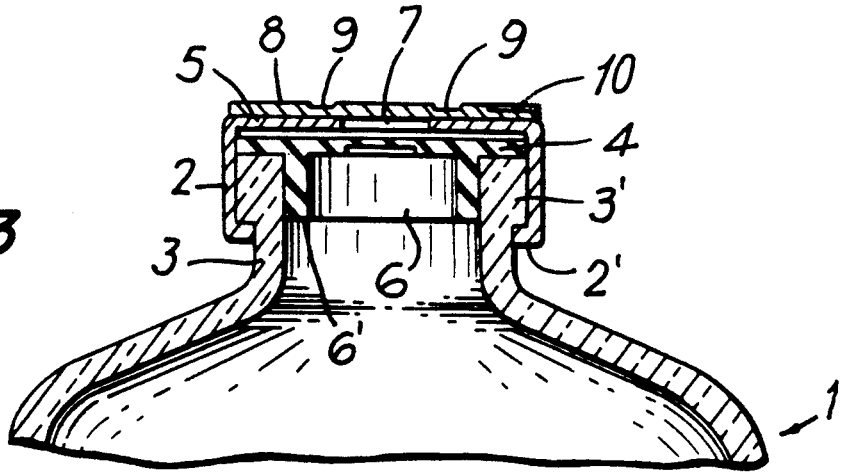
FIG. 3 is a cross-sectional view of the sealing cap along the line III—III of FIG. 1.

Usually, according to the known art, and as shown in FIG. 3, the sealing 4 element has a thickness reduction in the area to be pricked by the syringe needle to facilitate said operation.

The upper wall 5 of the cap 2 has a central through hole 7 which is subsequently covered by an aluminium foil 8. The contact surfaces between the wall 5 and the foil 8 are preferably lacquer.

The foil 8 is attached to the wall 5 by welding.

The welding may take place along one or more annular strips 9 peripherally surrounding the hole 7, as shown in the enclosed figures, or may intersect all the contact surface between the wall 5 and the foil 8, except for the grip tongue 10, provided close to the outer outline of the foil 8, without projecting from the latter. The tongue 10 is provided with knurls 11 obtained by riveting the tongue to the end to facility the grip and the subsequent removal of foil 8. The foil 8 virtually covers the whole upper wall 5 of the cap 2 and perfectly adheres thereto, included the knurled tongue 10 which is not welded and does not project beyond the lateral outline of the cap 2.

In said manner the inconveniences encountered in the previously mentioned cap fitting machines are eliminated.

The foil 8, applied to the upper wall 5 of the cap 2 constitutes an excellent sealing element with regard to the underlaying seal 4, and may be easily removed to release the hole 7 exerting a suitable traction on the grip tongue 10.

Of course the invention is not limited to the particular embodiment previously described and shown in the enclosed drawings, but modifications in the details may be resorted to without departing from the scope of the invention.

I claim:

1. A sealing cap made of a metallic material for closing antibiotic, infusion and transfusion bottles, said sealing cap comprising an upper wall and a through hole formed therein; and a metallic foil for tightly closing said hole, said metallic foil being congruent with and abutting the entire upper surface of said upper wall and having a knurled grip tongue that does not project beyond a periphery of said sealing cap.

2. A sealing cap as set forth in claim 1, wherein said metallic material is aluminum.

3. A sealing cap as set forth in claim 1, wherein said abutting surfaces of said upper wall and said metallic foil are covered with lacquer.

4. A sealing cap as set forth in claim 1, wherein said metallic foil has a continuous strip surrounding said hole in said upper wall and along which said metallic foil is welded to said upper wall.

5. A sealing cap as set forth in claim 1, wherein said metallic foil and said upper wall are welded to each other along substantially an entire area of abutting surfaces of said upper wall and said metallic foil except a region of said knurled grip tongue.

* * * * *